US006651283B1

(12) United States Patent
Cook et al.

(10) Patent No.: US 6,651,283 B1
(45) Date of Patent: Nov. 25, 2003

(54) AIR BED

(75) Inventors: Brian R. Cook, Washougal, WA (US); Randal R. Potter, Vancouver, WA (US)

(73) Assignee: The Nautilus Group, Inc., Vancouver, WA (US)

( * ) Notice: Subject to any disclaimer, the term of this patent is extended or adjusted under 35 U.S.C. 154(b) by 0 days.

(21) Appl. No.: 09/138,825

(22) Filed: Aug. 24, 1998

(51) Int. Cl.[7] ..... A47C 27/00
(52) U.S. Cl. ..... 5/713; 5/710; 5/706; 5/655.3
(58) Field of Search ..... 5/713, 710, 706, 5/654, 644, 655.3, 680, 670

(56) References Cited

U.S. PATENT DOCUMENTS

| | | | | | |
|---|---|---|---|---|---|
| 3,148,391 | A | | 9/1964 | Whitney | |
| 3,678,520 | A | | 7/1972 | Evans et al. | |
| 3,701,173 | A | | 10/1972 | Whitney | |
| 4,292,702 | A | | 10/1981 | Phillips | |
| 4,391,009 | A | | 7/1983 | Schild et al. | |
| 4,644,597 | A | | 2/1987 | Walker | |
| 4,799,277 | A | * | 1/1989 | Goodale | 5/680 X |
| 4,829,616 | A | | 5/1989 | Walker | |
| 4,890,344 | A | | 1/1990 | Walker | |
| 4,897,890 | A | | 2/1990 | Walker | |
| 4,908,895 | A | | 3/1990 | Walker | |
| 4,982,466 | A | * | 1/1991 | Higgins et al. | 5/713 |
| 4,991,244 | A | | 2/1991 | Walker | |
| 4,998,310 | A | * | 3/1991 | Olson | 5/706 X |
| 5,020,176 | A | * | 6/1991 | Dotson | 137/487.5 |
| 5,103,518 | A | | 4/1992 | Gilroy et al. | |
| 5,168,589 | A | * | 12/1992 | Stroh et al. | 5/710 |
| 5,170,522 | A | | 12/1992 | Walker | |
| 5,243,723 | A | | 9/1993 | Cotner et al. | |
| 5,412,821 | A | * | 5/1995 | Wilkinson | 5/709 |
| 5,416,937 | A | | 5/1995 | Johenning | |
| 5,421,044 | A | * | 6/1995 | Steensen | 5/710 |
| 5,469,589 | A | * | 11/1995 | Steed et al. | 5/201 |
| 5,509,154 | A | | 4/1996 | Shafer et al. | |
| 5,606,756 | A | * | 3/1997 | Price | 5/713 |
| 5,647,078 | A | * | 7/1997 | Pekar | 5/655.3 |
| 5,651,151 | A | * | 7/1997 | Schild | 5/710 |
| 5,655,239 | A | * | 8/1997 | Caparon et al. | 156/272.2 |
| 5,669,094 | A | * | 9/1997 | Swanson | 5/740 |
| 5,901,393 | A | | 5/1999 | Pepe | |

* cited by examiner

*Primary Examiner*—Teri Pham Luu
*Assistant Examiner*—Fredrick Conley
(74) *Attorney, Agent, or Firm*—Edward S. Wright

(57) ABSTRACT

Air bed assembly having a knockdown foundation made up of preassembled boxes which are used as shipping containers for the other elements of the bed, mattresses having interposed sets of isolated chambers for improved pressure distribution, contoured foam rails surrounding the mattresses and a visco-elastic foam pad overlying them, a cover with a removable pillow top enclosing the mattresses and foam, a blower assembly mounted inside one of the rails with control valves for supplying air to and removing air from the mattresses, and individual controls for returning the pressure in the mattresses to a desired level upon command and for preventing a drop in mattress pressure as the blower is turned on to increase that pressure.

21 Claims, 4 Drawing Sheets

AIR BED

This invention pertains generally to mattresses and beds and, more particularly, to an air bed.

Beds heretofore provided have, for the most part, employed innerspring mattresses and foundations, although some alternative support systems such as waterbeds and air beds have also been provided. Air beds have certain advantages in that the pressure within an air mattress, and hence the firmness of the bed, can be adjusted to suit the needs of the person sleeping on it. In beds designed for more than one person, side-by-side air mattresses have been employed, and with the firmness of each mattress controlled independently. Examples of air beds, controls and related components are found in U.S. Pat. Nos. 4,644,597, 4,829,616, 4,890,344, 4,897,890, 4,908,895, 4,991,244, 5,144,706, 5,170,522 and 5,509,154.

It is in general an object of the invention to provide a new and improved air bed.

Another object of the invention is to provide an air bed of the above character which overcomes the limitations and disadvantages of air beds and other sleep systems of the prior art.

These and other objects are achieved in accordance with the invention by providing an air bed having a knockdown foundation made up of preassembled boxes which are used as shipping containers for the other elements of the bed, mattresses having interposed sets of isolated chambers for improved pressure distribution, contoured foam rails surrounding the mattresses and a visco-elastic foam pad overlying them, a cover with a removable pillow top enclosing the mattresses and foam, a blower assembly mounted inside one of the rails with control valves for supplying air to and removing air from the mattresses, and individual controls with means for returning the pressure in the mattresses to a desired level upon command and means for preventing a drop in mattress pressure as the blower is turned on to increase that pressure.

Figure 1:
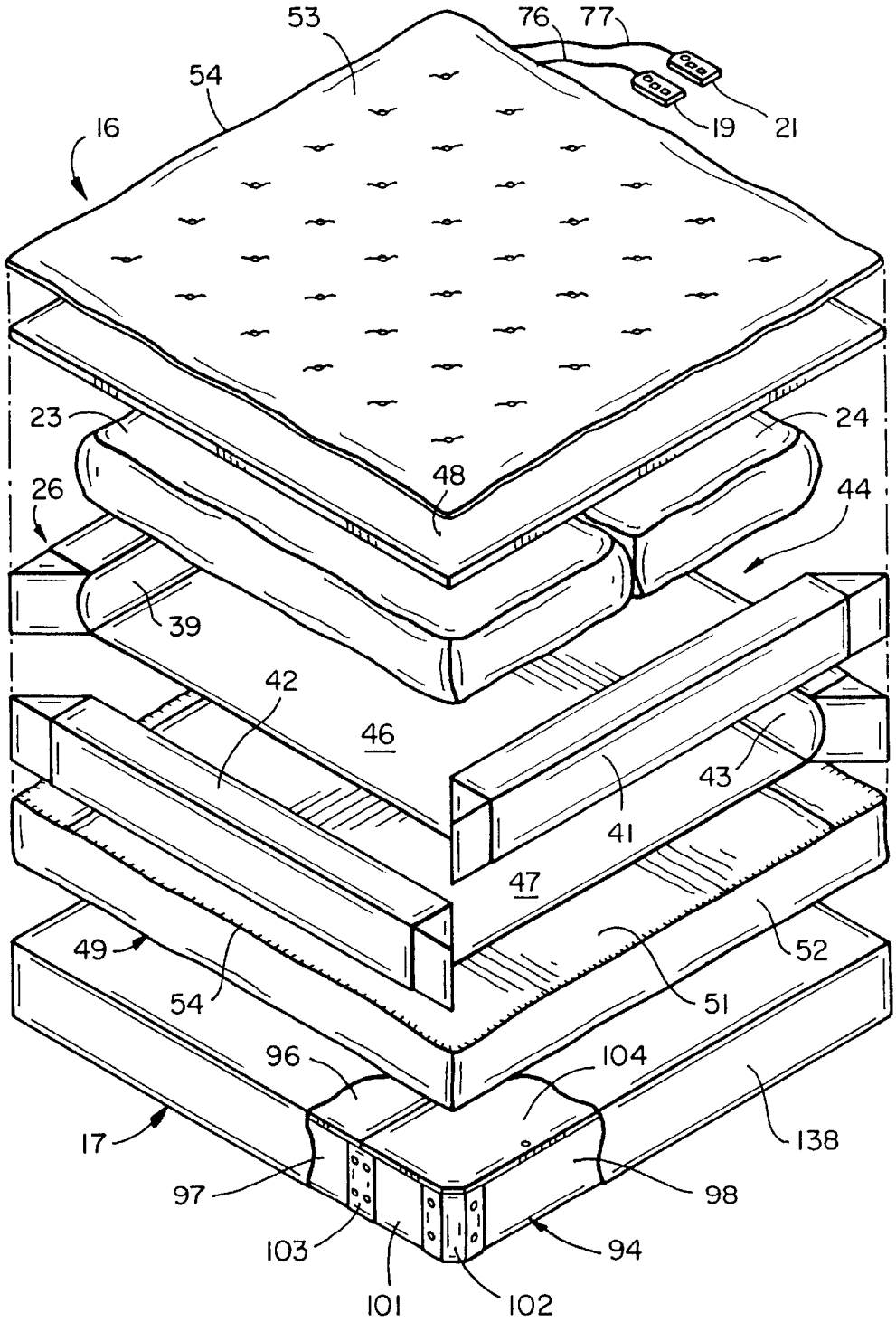
FIG. 1 is an exploded isometric view, partly broken away, of one embodiment of an air bed incorporating the invention.
Figure 2:
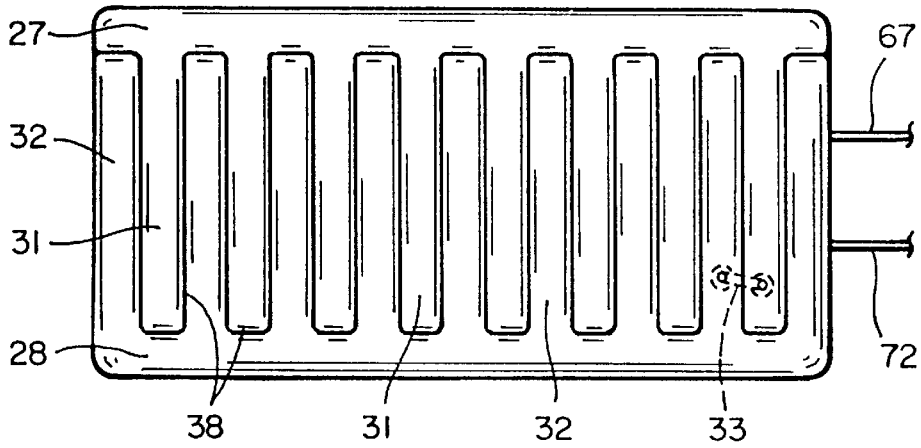
FIG. 2 is a top plan view of one of the air mattresses in the embodiment of FIG. 1.
Figure 3:
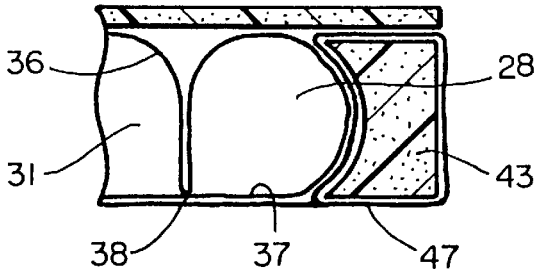
FIG. 3 is a fragmentary cross-sectional view of an air mattress and rail in the embodiment of FIG. 1.
Figure 4:
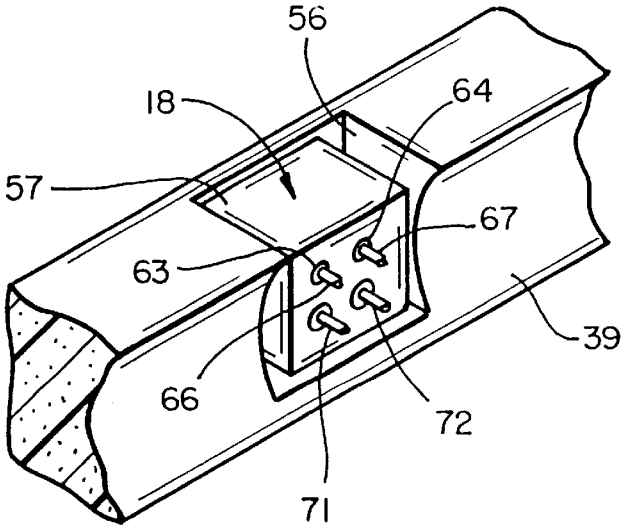
FIG. 4 is a fragmentary isometric view of the head rail of the mattress in the embodiment of FIG. 1.
Figure 5:
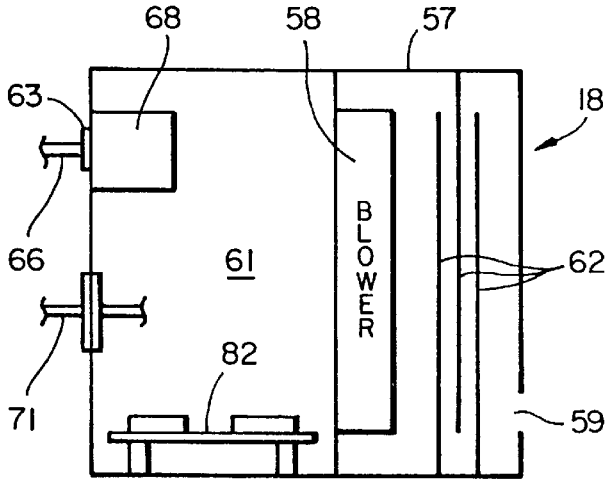
FIG. 5 is a sectional view, somewhat schematic, of the blower assembly in the embodiment of FIG. 1.
Figure 6:
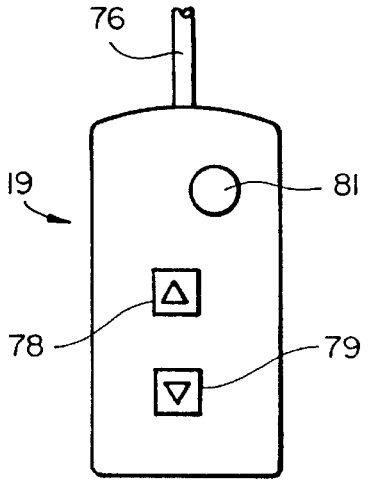
FIG. 6 is a top plan view of one of the controllers in the embodiment of FIG. 1.
Figure 7:
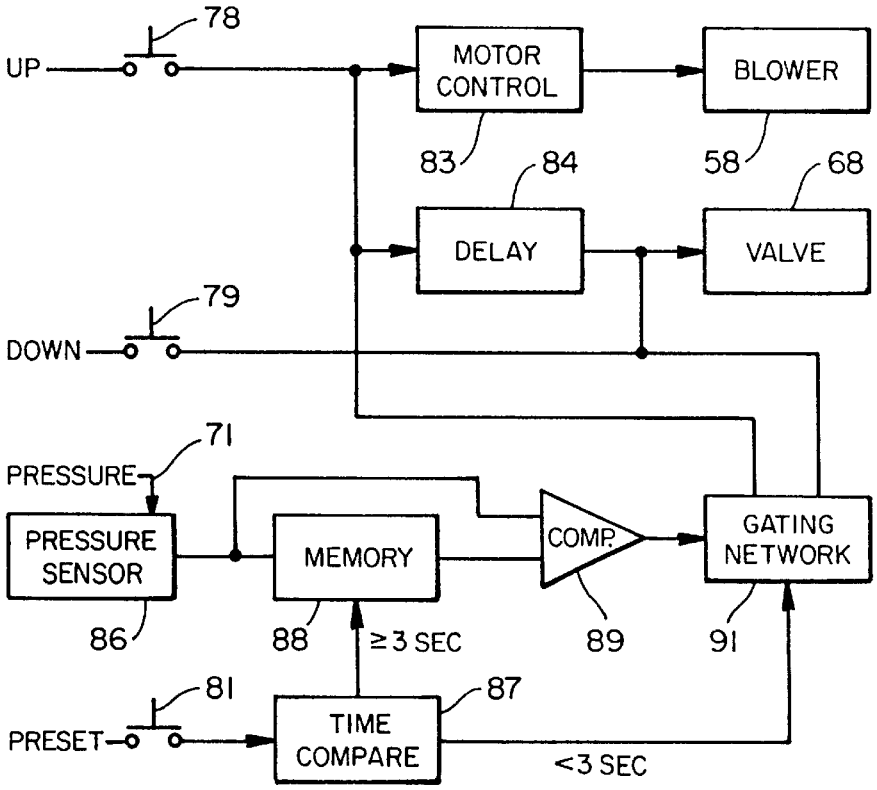
FIG. 7 is a functional block diagram of the control system for one of the mattresses in the embodiment of FIG. 1.
Figure 8:
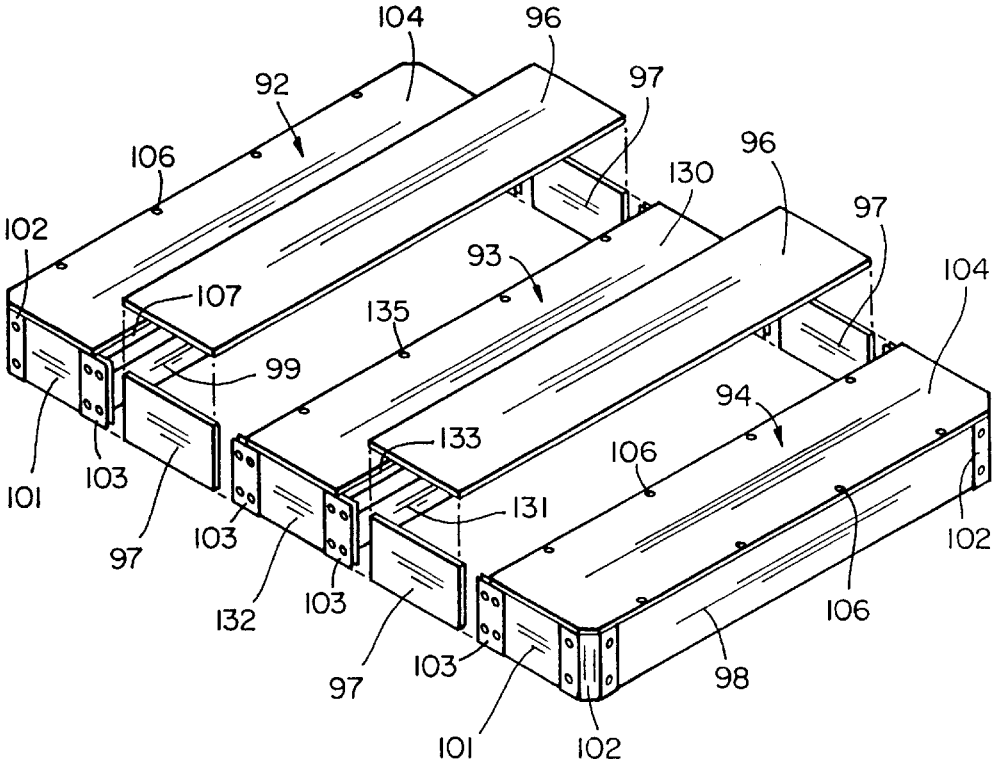
FIG. 8 is an exploded isometric view of the foundation in the embodiment of FIG. 1.
Figure 9:
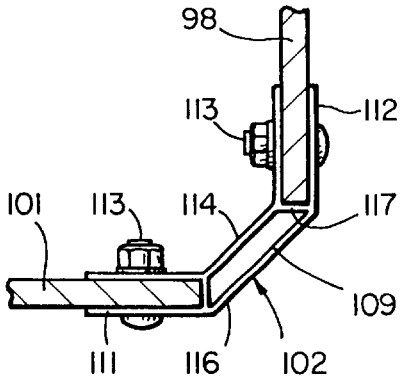
FIGS. 9 and 10 are fragmentary cross-sectional views of connectors utilized in the foundation in the embodiment of FIG. 1.
Figure 10:
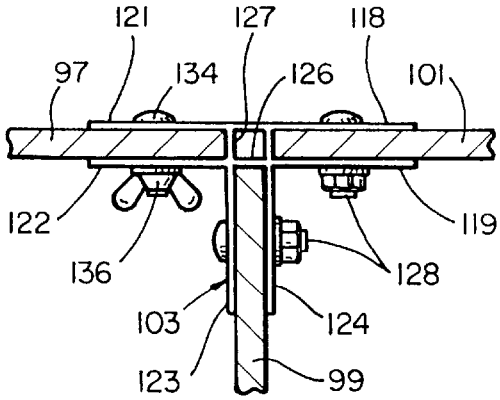

As illustrated in the drawings, the air bed includes a mattress 16 which rests on a foundation 17. A blower assembly 18 is mounted inside the mattress for increasing and decreasing pressure within the mattress, and a pair of controls 19, 21 are connected to the blower assembly for controlling the pressure within, and hence the firmness of, the mattress.

Mattress 16 includes a pair of air inflatable mattresses 23, 24 which are positioned side-by-side within a circumscribing foam frame 26. Each of the mattresses has elongated plenum chambers 27, 28 extending longitudinally from head to foot along opposite side margins of the mattress, and two sets of transversely extending channels or chambers 31, 32. The two sets of chambers are isolated from each other, with chambers 31 communicating with plenum chamber 27 but not with plenum chamber 28, and chambers 32 communicating with plenum chamber 28, but not with plenum chamber 27. The chambers in the two sets are spaced longitudinally apart and interspersed between each other so as to alternate along the length of the mattress. With the chambers alternating in this manner, a push applied to one chamber is transmitted at least two chambers away and distributed throughout the other chambers in communication with it. It does not affect the pressure in the other set of chambers, and those chambers continue to maintain their level of support. Thus, when a person changes sleeping position, the support stays with him.

An air line 33 is connected between two adjacent chambers on the under side of the mattress toward the head of the bed to provide communication between the chambers in the two sets for purposes of increasing and decreasing pressure within the mattress.

Each of the air mattresses has upper and lower sheets 36, 37 of a flexible thermoplastic material such as vinyl. The upper sheet is heated and drawn over a mold to the contour of the chambers and then bonded to the flat lower sheet along seal lines 38 to form the chambers.

If desired, conventional air mattresses can be used in place of the mattresses with the interposed chambers, in which case each mattress should preferably have a depth of at least 8 inches. If greater depth is desired with the mattresses having interposed chambers, those mattresses can be stacked.

The circumscribing foam frame 26 has a head rail 39, a foot rail 41 and side rails 42, 43 which define a cavity 44 in which the mattresses are received. The rails or cushions are held in place by sheets 46, 47 of flexible material such as a woven fabric which wrap around the rails and extend beneath the mattresses in crossing fashion. Thus, sheet 46 is wrapped about the head and foot rails and extends lengthwise of the bed beneath the mattress, and sheet 47 is wrapped about the side rails and extends across the bed beneath sheet 46.

The end and side walls of the inflated air mattresses are outwardly convex, and the inner walls of the foam rails are formed with a corresponding concave contour so that the walls of the mattresses extend into and conform to the inner walls of the rails. This interlocking of the mattresses and the frame provides smooth edges and helps to maintain the shape and comfort of the mattress.

A layer or pad 48 of visco-elastic foam overlies the air mattresses and the circumscribing foam frame. This is an open cell polymeric foam, sometimes called "memory foam", which returns to its original shape once a pressure applied to it is removed. It conforms closely to the contours of a body resting on it and distributes the weight of the entire body evenly over the sleeping surface.

Mattress 16 also includes a cover 49 which encloses the other elements of the mattress. This cover includes a lower section consisting of a bottom wall 51 which extends beneath the air mattresses and frame and a side wall 52 which extends along the outer side of the circumscribing foam frame. It also includes a removable pillow top 53 which is attached to the lower section by a zipper 54 that extends about the periphery of the mattress at the top of side wall 52 and on the under side of the pillow top. The pillow top contains a cushioning material and is covered with a suitable material such as a damask fabric. The pillow top can be removed for cleaning and/or replacement, and different tops can be used during different times of the year. Thus, for example, a silk blend might be used for coolness in the summer, and a cashmere blend might be used for extra warmth in the winter. For extra firmness, the pillow top can be replaced with a single layer of fabric without any padding.

Blower assembly 18 is mounted in a recess or cavity 56 in the head rail 39 of the circumscribing foam frame. In that location, it is not likely to be sat upon by a person getting onto or off the bed, or by persons sitting on the bed. In the embodiment illustrated, it is located toward the center of the rail, on the longitudinal centerline of the bed, where it is not likely to be contacted by persons sleeping on the two sides of the bed. Even if there is incidental contact, e.g. by a hand or an arm, that contact will be padded by foam pad 49 and the padding within the pillow top.

The blower assembly includes a generally rectangular housing 57 in which a blower 58 is mounted. The housing has an inlet opening 59 for air in the rear wall thereof, an internal chamber 61 and a series of baffles 62 between the inlet opening and the chamber. The blower draws air into the chamber through the opening and the baffles.

The blower assembly also has air outlets 63, 64 which are connected to respective ones of the air mattresses by air lines 66, 67. Communication between chamber 61 and the air outlets is controlled by solenoid operated valves 68, 69. Pressure sensing, or feedback, lines 71, 72 extend between the mattresses and pressure sensors in the blower assembly.

Control units 19, 21 are connected to the blower assembly by cables 76, 77, and can be positioned on a night stand or in another convenient location for persons resting on the bed. Each of the control units has a first pushbutton switch 78 for increasing the air pressure in the mattress, a second pushbutton switch 79 for decreasing the air pressure in the mattress, and a third pushbutton switch 81 for automatically setting the pressure to a desired level.

Control circuitry for the blower assembly is mounted on a circuit board 82 inside the blower housing. This circuitry includes a motor controller 83 for applying an energizing current to the blower motor in response to closure of the INCREASE PRESSURE switch 78 on one of the control units. The corresponding control valve 68 or 69 is also opened in response to the closure of the switch, but actuation of the valve is delayed until the pressure builds up in chamber 61 so that the pressure within the mattress will not drop momentarily. For this purpose, a delay circuit 84 having a period of one second is interposed between the switch and the valve. Thus, the valve does not open until one second after the motor is turned on.

The DECREASE PRESSURE switch 79 is connected directly to the controller for the valve, and closing that switch causes the valve to open immediately, venting air from the mattress back through the chamber, the blower, and the opening 59 in the back wall of the blower housing.

Means is also provided for automatically returning the pressure in the mattresses to a desired level. For each mattress, this means includes a pressure sensor 86 which is connected to the feedback line 71 or 72 for monitoring the pressure within the mattress. It also includes a timing circuit 87 for monitoring the state of PRESET switch 81. When that switch is depressed for more than a predetermined time (e.g., 3 seconds), a signal corresponding to the current mattress pressure is stored in a memory 88. When the switch is closed for a lesser time, the current mattress pressure is compared with the stored pressure in a comparator 89, and a gating circuit 91 is actuated to apply signals to the blower and/or valve to return the pressure in the mattress to the level which was stored.

Thus, when the mattress has the firmness to which a person wants to be able to return, he can press the PRESET button to close switch 81 for 3 seconds or more. Thereafter, he can return to that pressure by simply pressing the button again and releasing it in less than 3 seconds.

The current applied to the blower motor is a standard line current (e.g., 120 volts AC), but the rest of the system, including the switches in the control units, operates at low voltage, thereby avoiding any possible chance of shock hazard.

Foundation 17 is a knockdown foundation which is made up of three inverted, generally rectangular, preassembled boxes 92–94 which, prior to assembly of the bed, are also suitable for use as shipping containers for the other components of the bed. Boxes 92 and 94 are similar in structure and serve as head and foot sections of the foundation, while box 93 serves as a center section. Intermediate platform members 96 and upright members 97 are removably mounted between the boxes to complete the foundation.

Boxes 92, 94 each include side panels 98, 99 and end panels 101, with one of the side panels 98 being attached to the two end panels by corner connectors 102, and the other side panel 99 being attached to the end panels by T-connectors 103. The side panel with the corner connectors is located at the head or foot of the bed, and the side panel with the T-connectors faces toward the center of the bed. A generally rectangular top panel 104 is attached to the upper edges of the end and side panels by screws 106 and forms the bottom wall of the box when it is in an upright position. A cleat 107 extends along the upper edge of the outer side of panel 99 and is affixed to the panel by suitable means such as screws or glue.

Each of the corner connectors has a central web section 109 with spaced apart pairs of flanges 111, 112 extending at angles of 45° from opposite sides thereof to form an included angle of 90°. The end and side panels of the foundation section or box are received between the flanges and are retained there by carriage bolts 113 which pass through the flanges and the panel. The web section has inner and outer walls 114, 116 which form continuations of the flanges, with spacers 117 between the flanges where they join the web section serving as limiting abutments for the panels.

Each of the T-connectors has two pairs of spaced apart flanges 118, 119 and 121, 122 which are aligned in coplanar fashion with each other, and a third pair of flanges 123, 124 which is perpendicular to the other two. Spacers 126, 127 extend between the flanges where they come together. End panels 101 are received between flanges 118, 119, and side panel 99 is received between flanges 123, 124. They are held in place by carriage bolts 128.

Box 93 has side panels 131 and end panels 132, with T-connectors 103 at all four corners of this box. As in the case of the outer sections or boxes, the side panels are received between flanges 123, 124, the end panels are received between flanges 118, 119, and the panels are held in place by carriage bolts 128. A top panel 130 is attached to the upper edges of the side panels by screws 135. Cleats 133 extend along the upper edges of the outer sides of panels 131 and are affixed to the panels by suitable means such as screws or glue.

Upright members 97 are received between flanges 121, 122 of the T-connectors on the sides of end sections 92, 94 and center section 93 which face each other. They are releasably secured in position by carriage bolts 134 and wing nuts 136. Intermediate platform members 96 rest on cleats 107, 133 and on the upper edges of upright members 97 and, together with panels 104, 130, form a horizontally extending platform for supporting the mattress.

The upright members and panels which make up the boxes and the rest of the foundation are fabricated of a rigid material such as plywood, particle board or a suitable plastic, and in one presently preferred embodiment, they are all fabricated of plywood having a thickness on the order of 5/16 inch. The corner connectors and T-connectors are fabricated of a suitable material such as metal or plastic, and they are formed by an extrusion process.

The foundation is covered by a coverlet 138 which, in the embodiment illustrated, matches mattress cover 49. It can, however, be fabricated of another material, such as a coordinating fabric, if desired.

The invention has a number of important features and advantages. It provides an air bed in which two people can each adjust the firmness of their own individual mattresses to that which is the most comfortable for them, and each person can return to a desired firmness by a simple push of a button. Undesired pressure drops and increases are eliminated, and shipping is simplified by constructing the foundation from boxes which can also be used as shipping containers. Assembly and disassembly of the foundation are very easy since all that needs to be done is to slip the four upright members into the T-connectors which are already attached to the three boxes, install the carriage bolts and wing nuts that hold them in place, and drop the two platform members into position between the boxes.

It is apparent from the foregoing that a new and improved air bed has been provided. While only certain presently preferred embodiments have been described in detail, as will be apparent to those familiar with the art, certain changes and modifications can be made without departing from the scope of the invention as defined by the following claims.

What is claimed is:

1. In an air bed:

a knockdown foundation made up of preassembled boxes which prior to assembly of the bed are suitable for use as shipping containers for other elements of the bed;

a pair of mattresses resting on the foundation, each of the mattresses having first and second sets of air chambers interspersed between each other, with the chambers in each set being in open communication with each other but not with the chambers in the other set;

contoured foam rails surrounding the mattresses;

a visco-elastic foam pad overlying the mattresses;

a cover with a removable pillow top enclosing the mattresses, rails and foam pad;

a blower assembly mounted inside one of the rails with control valves for supplying air to and removing air from the mattresses;

individual controls for the respective mattresses;

means connected to the valves for returning the pressure in the mattresses to a desired level in response to a command issued through the controls; and means for controlling operation of the valves to prevent a drop in mattress pressure as the blower is turned on to increase the pressure within the mattresses.

2. In an air bed:

a foundation;

a pair of air inflatable mattresses disposed side-by-side on the foundation, each of the mattresses having first and second longitudinally extending chambers extending along opposite sides of the mattress, a first set of longitudinally spaced apart transversely extending chambers communicating with the first longitudinally extending chamber but not the second, a second set of longitudinally spaced apart transversely extending chambers interspersed between the transversely extending chambers of the first set and communicating with the second longitudinally extending chamber but not the first;

a circumscribing frame of resilient foam in peripheral engagement with the mattresses;

a visco-elastic foam pad overlying the mattresses for conforming to the contour of bodies resting thereon;

a cover including a detachable pillow top enclosing the mattresses, frame and pad; and means including a blower assembly mounted in the foam frame for selectively introducing air into and removing air from each of the mattresses to individually control the firmness of the mattresses.

3. The air bed of claim 2 wherein the foundation comprises a plurality of individually preassembled boxes which prior to assembly of the bed are used as shipping containers for other elements of the bed connected together to form a horizontally extending platform.

4. The air bed of claim 3 wherein the foundation comprises a plurality of individually preassembled boxes which prior to assembly of the bed are used as shipping containers for other elements of the bed connected together to form a horizontally extending platform.

5. The air bed of claim 2 wherein the mattress have outwardly convex end and side walls, and the circumscribing frame has end and side rails with concave inner walls defining a cavity for receiving the mattresses with the convex walls of the mattress extending into and conforming to the concave inner walls of the rails.

6. The air bed of claim 2 wherein the circumscribing frame has end and side rails held together by a first sheet of flexible material wrapped about the end rails and extending beneath the mattresses, and a second sheet of flexible material wrapped about the side rails and extending beneath the mattresses in crossing fashion with the first sheet.

7. The air bed of claim 2 wherein the blower assembly includes an air chamber, an air inlet and a pair of air outlets in communication with the chamber, a blower for drawing air Into the chamber through the inlet, and valves controlling communication through the outlets; and the means for introducing air into and removing air from the mattresses also includes means connecting the outlets of the blower assembly in communication with respective ones of the air mattresses, an individual controller for each of the mattresses, and means responsive to respective ones of the controllers for opening the valves while the blower is turned on to increase air pressure within the mattresses and for opening the valves while the blower is turned off to vent air from the mattresses through the air Inlet and thereby decrease the air pressure within the mattresses.

8. The air bed of claim 7 including pushbutton switches, means for monitoring the air pressure within each of the mattresses, means responsive to the switches and to the monitored pressures for storing the pressures within the mattresses as a desired levels of pressure when the pushbuttons are depressed for a predetermined period of time, and means responsive to the switches for operating the blower and the valves to adjust the pressure within the mattresses to the desired levels when the pushbuttons are depressed and released in a time less than the predetermined period.

9. The air bed of claim 7 including means for delaying the opening of the valves to increase pressure until after the blower has started operating to avoid a drop in pressure within the mattresses when the valves are opened.

10. In an air bed: a mattress comprising a relatively flat first sheet of flexible material, and a second sheet of flexible material which is contoured and joined to the first sheet along seal lines to form first and second longitudinally extending chambers along opposite side edges of the mattress, a first set of longitudinally spaced apart transversely extending chambers communicating with the first longitudinally extending chamber but not the second, a second set of longitudinally spaced apart transversely extending chambers interspersed between the transversely extending chambers of the first set and communicating with the second longitudinally extending chamber but not the first, and means for introducing air into the longitudinally and transversely extending chambers to inflate the mattress, the first sheet remaining substantially flat when the mattress is inflated, and the chambers being formed within space bounded by the contoured second sheet on one side of the first sheet.

11. The air bed of claim 10 wherein the means for introducing air into the chambers comprises a controlled opening in communication with the chambers.

12. The air bed of claim 10 including a relatively small air line interconnecting one of the chambers in the first set and one of the chambers in the second set.

13. In an air bed: an air inflatable mattress having outwardly convex end and side walls, and a resilient circumscribing frame having end and side rails with concave inner walls defining a cavity for receiving the mattress with the convex walls of the mattress extending into and conforming to the concave inner walls of the rails, a first sheet of flexible material wrapped about the end rails and extending lengthwise of the mattress, and a second sheet of flexible material wrapped about the side rails and extending across the mattress in crossing fashion with the first sheet.

14. The air bed of claim 13 including a flexible cover enclosing the mattress and the circumscribing frame.

15. The air bed of claim 14 wherein the cover includes a removable pillow top which overlies the mattress.

16. In an air bed: a foundation having two outer sections and a center section each of which is in the form of a generally rectangular inverted box having end walls, side walls and a generally planar top wall, the two outer sections being spaced from the center section with the side walls of the center section parallel to the side walls of the outer sections, intermediate upright members extending between the end walls of the outer sections and the center section, and intermediate platform members extending between the top walls of the outer sections and the center section to form a platform for supporting an air inflatable mattress, the intermediate upright members being connected to the outer and central sections by T-shaped connectors having a first pair of spaced apart parallel flanges between which an end portion of a side wall is received, a second pair of spaced apart parallel flanges between which an end portion of an end wall is received, and a third pair of spaced apart parallel flanges between which an end portion of an upright member is received, with the second and third pairs of flanges being aligned with each other and perpendicular, to the first pair of flanges.

17. The air bed of claim 16 wherein the top walls of the outer and center sections are permanently affixed to the end and side walls of those sections, and the intermediate uprights are removably attached to the outer and center sections.

18. The air bed of claim 16 further including cleats affixed to the side walls of the outer and center sections, with the intermediate platform members resting upon the Intermediate upright members and upon the cleats.

19. The air bed of claim 16 wherein the end walls of each of the outer sections are connected to one of the side walls of that section by corner connectors each of which has two pairs of spaced apart flanges in which end portions of the walls are received, and a central portion extending between the pairs of flanges at an angle of 45°.

20. The air bed of claim 9 wherein the central portion of each of the connectors has inner and outer walls which form continuations of the flanges.

21. The air bed of claim 16 wherein the first and second pairs of flanges are permanently connected to the side and end walls, and the third pair of flanges is releasably connected to the upright member.

* * * * *